US009809998B2

(12) United States Patent
Lai

(10) Patent No.: US 9,809,998 B2
(45) Date of Patent: Nov. 7, 2017

(54) LOCK

(71) Applicant: YIFENG MANUFACTURING CO.,LTD., Dongguan (CN)

(72) Inventor: Leo Lai, Dongguan (CN)

(73) Assignee: YIFENG MANUFACTURING CO., LTD., Dongguan (CN)

( * ) Notice: Subject to any disclaimer, the term of this patent is extended or adjusted under 35 U.S.C. 154(b) by 13 days.

(21) Appl. No.: 14/915,163

(22) PCT Filed: Apr. 19, 2015

(86) PCT No.: PCT/CN2015/076930
§ 371 (c)(1),
(2) Date: Feb. 26, 2016

(87) PCT Pub. No.: WO2015/165338
PCT Pub. Date: Nov. 5, 2015

(65) Prior Publication Data

US 2016/0222697 A1 Aug. 4, 2016

(30) Foreign Application Priority Data

Apr. 30, 2014 (CN) ..... 2014 1 0179928

(51) Int. Cl.
*E05B 37/00* (2006.01)
*E05B 65/52* (2006.01)

(52) U.S. Cl.
CPC ..... *E05B 37/0034* (2013.01); *E05B 37/0096* (2013.01); *E05B 65/52* (2013.01)

(58) Field of Classification Search
CPC ... E05B 37/0034; E05B 37/0096; E05B 65/52
USPC ..... 70/68, 284, 285
See application file for complete search history.

(56) References Cited

U.S. PATENT DOCUMENTS 6,807,832 B1 * 10/2004 Jeng ..... E05B 37/12 190/101
6,912,880 B2 * 7/2005 Ling ..... E05B 37/0034 70/284
7,415,853 B2 * 8/2008 Yu ..... E05B 37/02 70/21

(Continued)

FOREIGN PATENT DOCUMENTS

CN 104088531 A 10/2014
CN 203924950 U 11/2014

*Primary Examiner* — Suzanne Barrett
(74) *Attorney, Agent, or Firm* — Ming Chow; Sinorica, LLC

(57) ABSTRACT

A lock comprises an upper casing and a base plate connected to each other; between the upper casing and the base plate there is an accommodation space in which the locking device is. The locking device consists of a locking hook coordinated with the receiving hole at the top surface of the upper casing and a control unit to control the movement of the locking hook. The locking hook has a hook portion which can access the bottom end of the receiving hole and a connecting portion controlled by the control unit. At the left side of the receiving hole which the hook portion faces to, there is a side plate comprising an inclined upper part and a vertical part at the lower end, and the inclined part tilt outward towards the top surface of the receiving hole for locking two zipper pull tabs together conveniently.

10 Claims, 5 Drawing Sheets

(56) References Cited

U.S. PATENT DOCUMENTS 8,096,150 B2 * 1/2012 Lai ..... A44B 19/301 70/21
8,161,778 B1 * 4/2012 Ma ..... E05B 35/007 70/21
8,661,861 B2 * 3/2014 Lai ..... E05B 37/12 70/21
RE45,429 E * 3/2015 Ling ..... E05B 37/0034 70/284
9,512,647 B2 * 12/2016 Meersschaert ..... E05B 35/105
2005/0072196 A1 * 4/2005 Ling ..... E05B 37/0034 70/284
2006/0254329 A1 * 11/2006 Yu ..... E05B 37/02 70/284
2008/0060400 A1 * 3/2008 Ling ..... E05B 35/105 70/344
2008/0087049 A1 * 4/2008 Lai ..... A44B 19/301 70/25
2008/0236212 A1 * 10/2008 Ma ..... E05B 37/0034 70/77
2011/0138867 A1 * 6/2011 Lai ..... E05B 37/12 70/320
2013/0036778 A1 * 2/2013 Lai ..... E05B 37/12 70/63
2013/0067971 A1 * 3/2013 Huang ..... E05B 65/52 70/286
2013/0091906 A1 * 4/2013 Chen ..... E05B 65/52 70/68
2015/0014109 A1 * 1/2015 Lai ..... A45C 5/14 190/111
2015/0040622 A1 * 2/2015 Meersschaert ..... E05B 35/105 70/69
2015/0300049 A1 * 10/2015 Majeau ..... A44B 19/301 70/71
2015/0330104 A1 * 11/2015 Lai ..... E05B 37/12 70/285
2016/0215523 A1 * 7/2016 Lai ..... E05B 37/0034
2016/0290014 A1 * 10/2016 Lai ..... E05B 37/0031
2017/0074002 A1 * 3/2017 Cooper ..... E05B 35/105
2017/0081884 A1 * 3/2017 Meersschaert ..... E05B 35/105

* cited by examiner

LOCK

FIELD OF THE INVENTION

The present invention relates generally to a lock and more particularly to a mechanical lock.

BACKGROUND OF THE INVENTION

With the development of social economics and the improvement of living standards, people's traveling frequency is increasing. When people travel, they usually carry luggage cases which are opened or closed by the means of zipper. And there are a variety of luggage locks using in the cases on the market. However, the current luggage lock is generally controlled by two zipper pull tabs on the zipper; when the zipper pull tabs contact and fixed to the password lock, the luggage is locked. And such locks are usually one zipper pull tab positioned in a receiving hole and locked respectively. So such locks have a safety risk: 1. there are still some gaps between two zipper pull tabs resulted in the probability of running unknown objects into the luggage through the gap; 2. when one of the receiving holes is damaged, and if the user can't realize at once, it might cause loss.

SUMMARY OF THE INVENTION

The present invention remedies and overcome all of the foregoing deficiencies and disadvantages of presently available luggage locks by providing a new and novel lock for locking zipper, safe and easy to use.

The lock comprises an upper casing and a base plate connected to each other; between the upper casing and the base plate there is an accommodation space in which the locking device is. The locking device consists of a locking hook coordinated with the receiving hole at the top surface of the upper casing and a control unit to control the movement of the locking hook. The locking hook has a hook portion which can access the bottom end of the receiving hole and a connecting portion controlled by the control unit; when the password is correct, the hook portion can be moved to the side of the receiving hole; and when the password is wrong, the movement of the connecting portion is limited by the control unit and the hook portion is fixed in the bottom end of the receiving hole. At the left side of the receiving hole which the hook portion faces to, there is a side plate comprising an inclined upper part and a vertical part at the lower end, and the inclined part tilt outward towards the top surface of the receiving hole.

Further, the control unit comprises a password mechanism including a plurality of code wheels, a switch, which connects with the connecting portion of the locking hook to control the movement of the locking hook, and a spring for the restoring of the switch. When the password is correct, the switch is unlocked, the locking hook can leave the receiving hole to unlock the luggage; when the password is incorrect, the switch is locked, the locking hook is limited in the locking position that the hook portion is located in the bottom end of the receiving hole.

Further, the switch can be a shaft lever passing through the code wheels. When the password is correct, the shaft lever can be moved relative to the code wheels; when the password is incorrect, the shaft lever is limited in the locking position.

Further, below the password mechanism there is a shrapnel including a fixed part fixed to the base and an elastic part abutted on the code wheels.

Further, the password mechanism further comprises a code resetting unit, three code resetting wheels being inside the code wheels. At one end of the shaft lever is a restoring spring, and a code resetting device including resetting block and resetting switch block is at the other end. The resetting block has a shaft hole for holding the shaft lever, and at the upper end of the resetting block is the first bevel for pushing the resetting block to the code wheels. And the resetting switch block next to the resetting block, at the lower end of which there is a second bevel matching with the first bevel, is installed in the code resetting hole at the top of the upper casing. The first thing to reset the code is rotating the code wheels to the proper position, then press the resetting switch block to push the resetting block forward to the code wheels and move the code resetting wheels against the restoring spring. After moving the code resetting wheels, the code wheels can rotate relative to the code resetting wheels to reset the code. Then release the resetting switch block and the code resetting wheels and the resetting switch will be back to the locking position driven by the restoring spring, and the password is reset.

Further, the control unit comprises a lock cylinder connected with the connecting portion of the locking hook. When the lock cylinder is unlocked, the locking hook can move away from the receiving hole.

Further, the control unit includes a locking block and a push key at the lower end of which is a lock cylinder housing fixed to the lock cylinder. And the lock cylinder can move in the accommodation space between the upper casing and the base plate and connects to a rotary block; and at the middle of the locking block there is a hole matched with the rotary block and a rectangle slot communicated with the hole. The rotary block is inserted into the hole, and one end of the shaft lever abuts against the locking block. The connecting portion moves together with the lock cylinder. There are two methods to unlock the luggage: using the password or the lock cylinder. Using the password to unlock the luggage, the lock cylinder will move to the right driven by the push key so that the locking hook moves to the right. However, when the lock cylinder is unlocked, the lock cylinder can move relative to the locking block, and the rotary block can be moved along the rectangle slot so that the locking hook can move away from the receiving hole to unlock the luggage. When the lock is locked, the movement of the shaft lever is limited and the rotary block is inserted in the hole.

Further, the lock cylinder comprises a connecting block under the locking block, and at one end of the connecting block there is a round hole matched with the rotary block and the other end of the connecting block extrudes to form a cavity fitted with the extrusion on the locking hook.

Further, under the resetting block is a lock block and under the resetting switch block is a retaining rod which fits into the retaining slot of the lock block.

Further, inside the receiving hole and under the hook portion is a top block, and an elastic element for raising the top block locates between the top block and the base plate.

Further, the lock includes a lower casing which is fixed to the upper casing.

The beneficial effects of the present invention is that the side plate of the receiving hole comprises an inclined upper part to lock two zipper pull tabs together conveniently, which is especially vital for luggage case with two zipper pull tabs.

DESCRIPTION OF THE PREFERRED EMBODIMENTS

Figure 1:
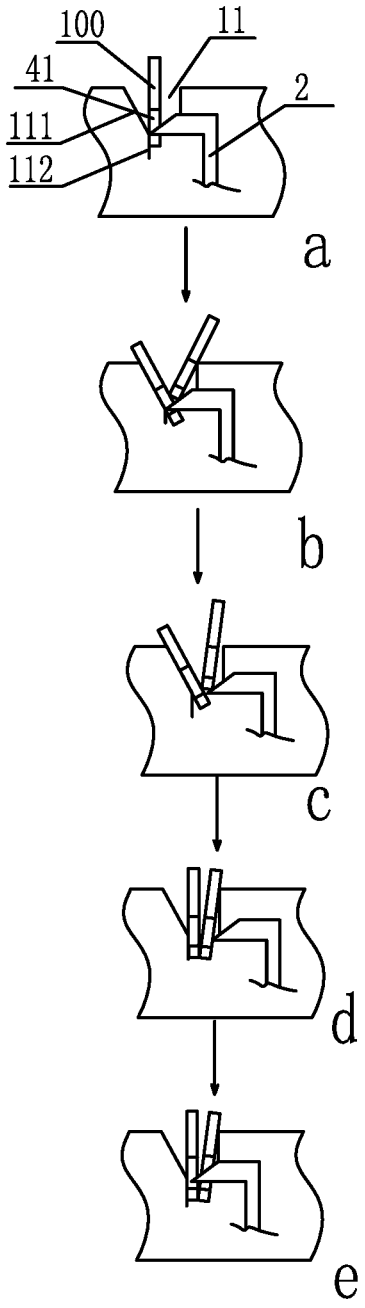
FIG. 1 is a flow chart for the engage process between the present invention and zipper pull tabs.
Figure 2:
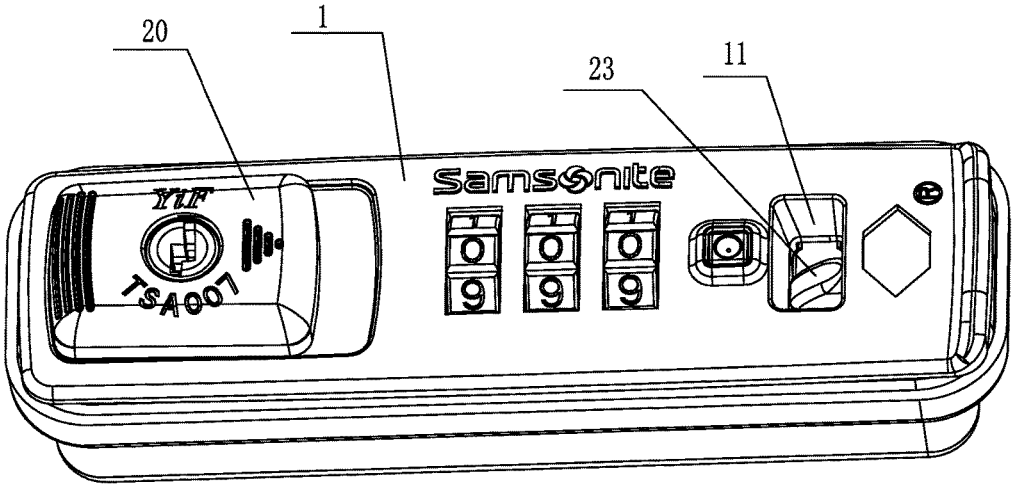
FIG. 2 is the schematic diagram for the present invention.
Figure 3:
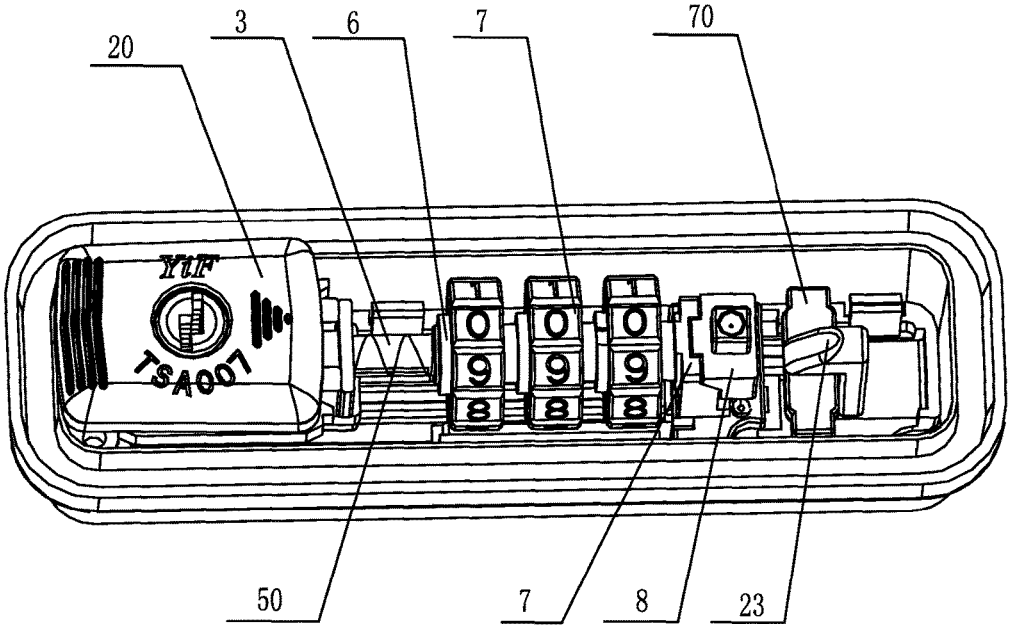
FIG. 3 is the schematic diagram for the present invention with the upper casing neglected.
Figure 4:
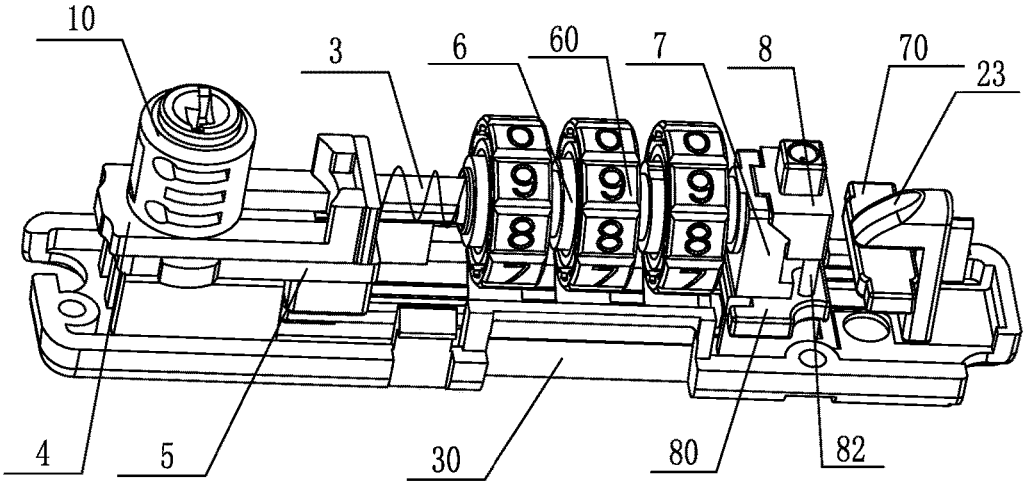
FIG. 4 is the schematic diagram the same as FIG. 3 with the lower casing and the push key neglected.
Figure 5:
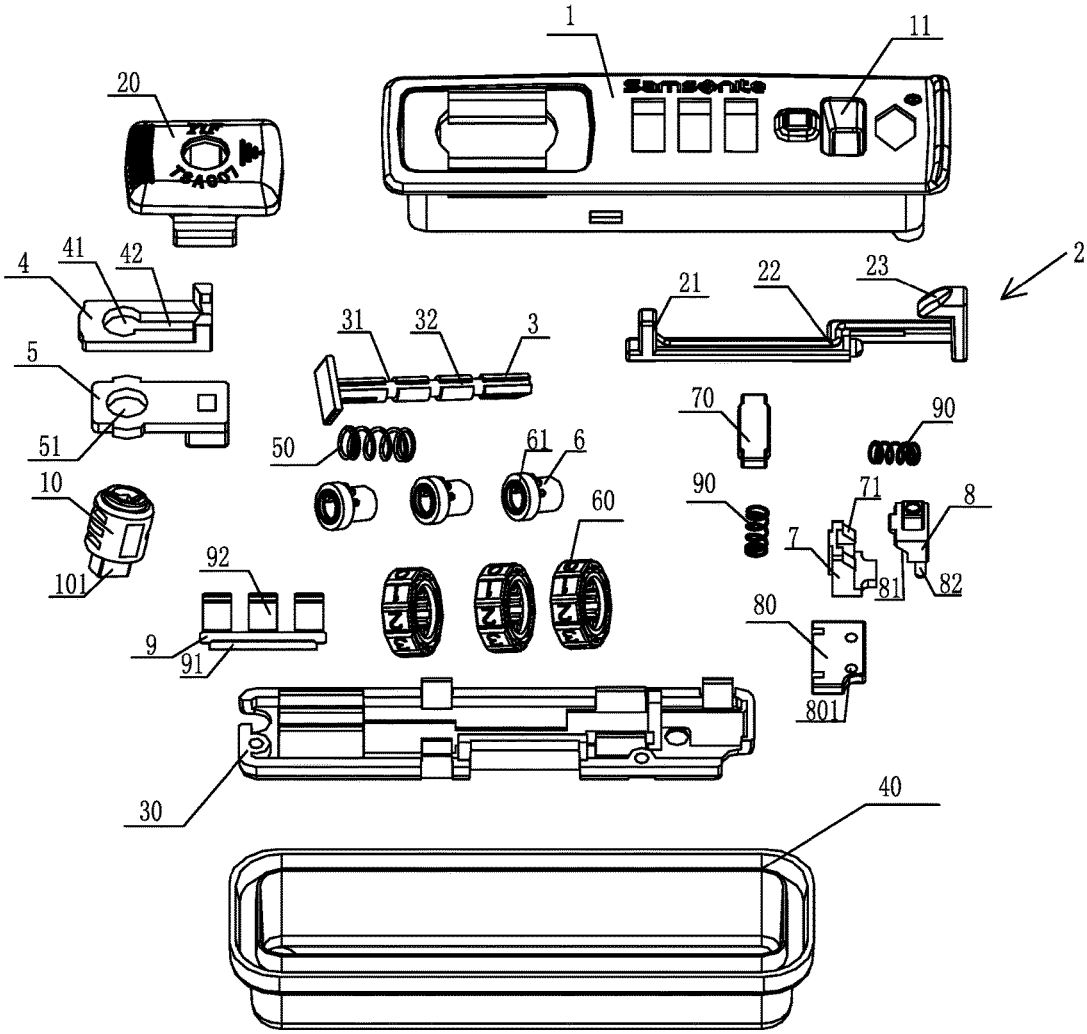
FIG. 5 is the explosive view of FIG. 2.

Refer to the drawings as hereinafter set forth in greater detail of the present invention.

Referring now to FIG. 1 to 5 of the drawing, the lock comprises an upper casing 1 and a base plate 30 connected to each other; between the upper casing 1 and the base plate 30 there is an accommodation space in which the locking device is. The locking device consists of a locking hook 2 coordinated with the receiving hole 11 at the top surface of the upper casing 1 and a control unit to control the movement of the locking hook 2. The locking hook 2 has a hook portion 23 which can access the bottom end of the receiving hole 11 and a connecting portion 22 controlled by the control unit; when the password is correct, the hook portion 23 can be moved to the side of the receiving hole 11; and when the password is wrong, the movement of the connecting portion 22 is limited by the control unit and the hook portion 23 is fixed in the bottom end of the receiving hole 11. At the left side of the receiving hole 11 which the hook portion 23 faces to, there is a side plate comprising an inclined upper part 111 and a vertical part 112 at the lower end, and the inclined part 111 tilt outward towards the top surface of the receiving hole 11.

The side plate of the receiving hole 11 is designed to include an inclined upper part and a vertical bottom part, so that the zipper pull tabs 100 can be inserted into the receiving hole 11 and locked arbitrarily. Two operating steps:

1. If the zipper pull tab 100 at the right side is inserted into the receiving hole 11 and secured by the hook portion 23 of locking hook 2 firstly, the operation of inserting another zipper pull tab 100 at the left side is very simple, just to push the right side zipper pull tab 100 and the hook portion 23 of locking hook 2 to the right during which the zipper pull tab keeps engaging with the hook portion 23; when the left side zipper pull tab 100 is inserted into the bottom end of the receiving hole 11, the locking hook 2 restores and the hook portion 23 inserts into the hasp 41 of the left side zipper pull tab 100 through the hasp 41 of the right side zipper pull tab 100, and the left side zipper pull tab 100 is engaged.
2. As shown in FIG. 1, if it is the zipper pull tab 100 at the left side inserted into the receiving hole 11 and secured by the hook portion 23 of locking hook 2 firstly, the lower end of the left side zipper pull tab 100 will contact with the vertical bottom part 112 of the receiving hole 11 closely, and the zipper pull tab 100 is vertical too (as shown in FIG. 1-*a*); then insert another zipper pull tab 100 at the right side of the receiving hole 11 during which the right side zipper pull tab 100 will be contact with the upper part of the left side zipper pull tab 100 and as the upper end of the receiving hole 11 is inclined, the right side zipper pull tab 100 will press the left side zipper pull tab 100 increasing the friction between the left side zipper pull tab 100 and the side plate on the left side of the receiving hole 11 (shown in FIG. 1-*b*). The right side zipper pull tab 100 contacts with the hook portion 23 and gradually pushes the hook portion 23 to the right until the hook portion 23 leaves the hasp 41 of the left side zipper pull tab 100 and the bottom end of the receiving hole 11 (as shown in FIG. 1-*c*); when the lower end of the right side zipper pull tab 100 enters into the bottom of the receiving hole 11, it will press the lower end of the left side zipper pull tab 100 and make the lower end of the left side zipper pull tab 100 vertical matching up with the vertical part 112 of the side plate of the receiving hole 11 (as shown in FIG. 1-*d*); then locking hook 2 restores and its hook portion 23 inserts into the hasps 41 of the right side zipper pull 100 and the left side zipper pull tab 100 successively to be engaged with the zipper pull tabs 100 (as shown in FIG. 1-*e*). In this process, the left side zipper pull tab 100 is being pressed by the right side zipper pull tab 100, so that the friction between the left side zipper pull tab 100 and the side plate of the receiving hole 11 become larger, preventing the left side zipper pull tab 100 leaving the receiving hole 11 during this process. For better connection to these two zipper pull tabs 100, the width of the bottom end of the receiving hole 11 should be equal or equivalent to the sum of the width of these two zipper pull tabs 100, so that during the right side zipper pull tab 100 inserts into the receiving hole 11, the left side zipper pull tab 100 is being squeezed. In specific embodiments, another side plate is set at the other side of the receiving hole 11, and there is a hole in the middle of this side plate for the movement of the hook portion 23 of the locking hook 2. So it can be easy to control the clearance of the lower end of the receiving hole 11.

There is a spring 90 in the accommodation space for the restoring of locking hook 2.

Further, the control unit comprises a password mechanism including a plurality of code wheels 60, a switch, which connects with the connecting portion 22 of the locking hook 2 to control the movement of the locking hook 2, and a spring 90 for the restoring of the switch. When the password is correct, the switch is unlocked, the locking hook 2 can leave the receiving hole 11 to unlock the luggage; when the password is incorrect, the switch is locked, the locking hook 2 is limited in the locking position that the hook portion 23 is located in the bottom end of the receiving hole 11.

The switch can be locking plates, the movement of which is controlled by the code wheels 60. When the password is correct, the locking plates is in unlocked position, the connecting portion of the locking hook 2 can separate or mismatch with the locking plates, the locking hook 2 can leave the receiving hole 11 to unlock the luggage; when the password is incorrect, the locking plates is in locked position, the locking plates abut the connecting portion of the locking hook 2 so that the locking hook 2 is limited in the locking position to lock the luggage.

Further, the switch can be a shaft lever 3 passing through the code wheels 60. When the password is correct, the shaft lever 3 can be moved relative to the code wheels 60; when the password is incorrect, the shaft lever 3 is limited in the locking position.

The password mechanism is designed that there is a axial movement groove 32 on the shaft lever 3 matched up with the blocks 61 on the inner surface of the code wheels 60; and there are also several annular grooves 31 in which the blocks 61 locate on the shaft lever 3. When the password is correct, blocks 61 locate in the intersection between the annular grooves 31 and the axial movement groove 32.

Further, below the password mechanism there is a shrapnel 9 including a fixed part 91 fixed to the base 30 and an elastic part 92 abutted on the code wheels 60.

The purpose of setting the shrapnel 9 is to make the code wheels 60 rotate more stably and improve the feel.

Further, the password mechanism further comprises a code resetting unit, three code resetting wheels 6 being inside the code wheels 60. at one end of the shaft lever 3 is a restoring spring 50, and a code resetting device including resetting block 7 and resetting switch block 8 is at the other end. The resetting block 7 has a shaft hole for holding the shaft lever 3, and at the upper end of the resetting block 7 is the first bevel 71 for pushing the resetting block 7 to the code wheels 60. And the resetting switch block 8 next to the resetting block 7, at the lower end of which there is a second bevel 81 matching with the first bevel 71, is installed in the code resetting hole at the top of the upper casing 1. The first thing to reset the code is rotating the code wheels 60 to the proper position, then press the resetting switch block 8 to push the resetting block 7 forward to the code wheels 60 and move the code resetting wheels 6 against the restoring spring 50. After moving the code resetting wheels 6, the code wheels 60 can rotate relative to the code resetting wheels 6 to reset the code. Then release the resetting switch block 8 and the code resetting wheels 6 and the resetting switch will be back to the locking position driven by the restoring spring 50, and the password is reset.

In the specific setting, the surface of code resetting wheel 6 has two regions, and when the password is incorrect, the code resetting wheel 6 and the code wheel 60 are connected with each other and rotate together. During the resetting of the password the code resetting wheels 6 are pushed to the left side by the resetting block 7, while the code wheels 60 are limited in the recesses of the upper casing 1 so that the code wheels 60 move to the other region of the code resetting wheel 6 and can rotate relative to the code resetting wheel 6. And the inner surface of the code resetting wheel 6 has a block 61 for controlling the movement of the shaft lever 3. That is to say the block 61 which should be at the code wheel 60 is provided by the code resetting wheel 6.

Further, the control unit comprises a lock cylinder 10 connected with the connecting portion 22 of the locking hook 2; when the lock cylinder 10 is unlocked, the locking hook 2 can move away from the receiving hole 11.

And the movement of locking hook 2 is controlled by the lock cylinder 10.

The control unit further includes a locking block 4 and a push key 20 at the lower end of which is a lock cylinder housing fixed to the lock cylinder 10. And the lock cylinder 10 can move in the accommodation space between the upper casing 1 and the base plate 30 and connects to a rotary block 101; and at the middle of the locking block 4 there is a hole 41 matched with the rotary block 11 and a rectangle slot 42 communicated with the hole 41. The rotary block 101 is inserted into the hole 41, and one end of the shaft lever 3 abuts against the locking block 4 and the connecting portion 22 moves together with the lock cylinder 10. There are two methods to unlock the luggage: using the password or the lock cylinder 10. Using the password to unlock the luggage, the lock cylinder 10 will move to the right driven by the push key 20 and thus the locking hook 2 moves to the right. However, when the lock cylinder 10 is unlocked, the lock cylinder 10 can move relative to the locking block 4, and the rotary block 101 can be moved along the rectangle slot 42 so that the locking hook 2 can move away from the receiving hole 11 to unlock the luggage. When the lock is locked, the movement of the shaft lever 3 is limited and the rotary block 101 is inserted in the hole 41. The rotary block 101 can be a rectangular or cam structure.

The combination of the locking block 4 and the push key 20 forms a combined lock, which can be unlocked by the password or the key. The locking hook 2 connects to the lock cylinder 10 through the connecting portion 22, so that the lateral movement of the lock cylinder 10 drives the locking hook 2 to move to unlock the luggage. There are two methods to move the lock cylinder 10: 1. using a password, when the password is correct, the shaft lever 3 can move relative to the code wheel 60 or code resetting wheel 6 and push the lock cylinder 10 to the right, so that the lateral movement of the lock cylinder 10 drives the locking hook 2 to move to unlock the luggage; 2. using the key, when the lock cylinder 10 is unlocked, the rotary block 101 can be moved along the rectangle slot 42. Although the locking block 4 is abutted against the shaft lever 3 which is limited in the locking position, the lock cylinder 10 can move relative to the locking block 4, and the rotary block 101 can move to the rectangle slot 42 from hole 41, so that the locking hook 2 can be moved away from the receiving hole 11 to unlock the luggage. A restoring spring 50 is arranged on the shaft lever 3 between the locking block 4 and the code wheel 60. When using the password to unlock the luggage, the shaft lever 3 moves and presses the restoring spring 50; after the lock is unlocked, the shaft lever 3 will be back to the locking position driven by the restoring spring 50. And it will be obvious that the restoring spring 50 may be provided between the locking block 4 and the shaft lever 3.

Further, the lock cylinder 10 comprises a connecting block 5 under the locking block 4, and at one end of the connecting block 5 there is a round hole 51 matched with the rotary block 101 and the other end of the connecting block 5 extrudes to form a cavity fitted with an extrusion 21 on the locking hook 2.

With the connecting block 5 and the extrusion 21, the lock cylinder 10 connects to the connecting portion so that the locking hook 2 moves together with the lock cylinder 10.

Further, under the resetting block 7 is a lock block 80 and under the resetting switch block 8 is a retaining rod 82 which fits into the retaining slot 801 of the lock block 80.

During resetting the password, the resetting switch block 8 will move relative to the resetting block 7, and with the lock block 80, retaining rod 82 and retaining slot 801 the movement of the resetting switch block 8 is oriented.

Further, inside the receiving hole 11 and under the hook portion 23 is a top block 70, and an elastic element 90 for raising the top block 70 locates between the top block 70 and the base plate 30.

It's very easy to unlock the lock as the top block 70 will bounce the zipper pull tabs 100. The elastic element 90 may be a spring, shrapnel and the like.

Further, the lock includes a lower casing 40 which is fixed to the upper casing 1.

The base plate 30 and the locking device are placed inside the lower casing 40 to avoid exposure.

While we have described our invention in detail in its present preferred embodiments, it will be obvious to those skilled in the art, after understanding our invention, that various changes and modifications may be made therein without departing from the spirit or scope thereof.

What is claimed is:

1. A lock comprising:

an upper casing;

a base plate;

the upper casing and the base plate being connected to each other;

a space;

the space being formed in between the upper casing and the base plate;

a locking device;

the locking device being accommodated within the space;

the locking device comprising a locking hook and a control unit;

the locking hook being coordinated with a receiving hole at a top surface of the upper casing and the control unit so as to control a movement of the locking hook;

the locking hook comprising a hook portion to access a bottom end of the receiving hole and a connecting portion controlled by the control unit;

the hook portion being moved to a side of the receiving hole in response to a password being correct;

a movement of the connecting portion being limited by the control unit and the hook portion being fixed in the bottom end of the receiving hole in response to the password being wrong;

the hook portion facing a left side of the receiving hole;

a side plate being located at the left side of the receiving hole;

the side plate comprising an inclined upper part and a vertical part at a lower end thereof; and the inclined part tilting outward towards a top surface of the receiving hole.

2. The lock of claim 1 comprising:

the control unit comprising a password mechanism, a switch and a spring;

the password mechanism comprising a plurality of code wheels;

the switch being connected with the connecting portion of the locking hook so as to control the movement of the locking hook;

the spring being used for a restoring of the switch;

the switch being unlocked and the locking hook leaving the receiving hole to unlock the luggage in response to the password being correct; and the switch being locked and the locking hook being limited in a locking position where the hook portion is located in the bottom end of the receiving hole in response to the password being wrong.

3. The lock of claim 2 comprising:

the switch being a shaft lever passing through the plurality of code wheels;

the shaft lever being moved relative to the plurality of code wheels in response to the password being correct; and the shaft lever being limited in the locking position in response to the password being wrong.

4. The lock of claim 2 comprising:

a shrapnel;

the shrapnel being located below the password mechanism; and the shrapnel comprising a fixed part fixed to the base plate and an elastic part abutted on the plurality of code wheels.

5. The lock of claim 3 comprising:

the password mechanism comprising a code resetting unit;

the code resetting unit comprising a plurality of code resetting wheels;

the plurality of code resetting wheels being inside the plurality of code wheels;

a restoring spring;

the restoring spring being located at one end of the shaft lever;

a code resetting device;

the code resetting device comprising a resetting block and a resetting switch block;

the resetting block and the resetting switch block being located at the other end of the shaft lever;

the resetting block comprising a shaft hole for holding the shaft lever and a first bevel;

the first bevel being formed at an upper end of the resetting block;

the first bevel being used for pushing the resetting block to the plurality of code wheels;

the resetting switch block being located next to the resetting block;

the resetting switch block comprising a second bevel;

the second bevel being formed at a lower end of the resetting switch block;

the second bevel matching with the first bevel;

the resetting switch block being installed in a code resetting hole at a top of the upper casing;

the plurality of code wheels being rotated to a proper position and the resetting switch block being pressed to push the resetting block forward to the plurality of code wheels and to move the plurality of code resetting wheels against the restoring spring so as to reset the password;

the plurality of code wheels being rotated relative to the plurality of code resetting wheels so as to reset the password in response to the plurality of code resetting wheels being moved; and the resetting switch being moved back to the locking position driven by the restoring spring and the password being reset in response to the resetting switch block and the code resetting wheels being released.

6. The lock of claim 3 or 5, comprising the control unit comprising a lock cylinder;

the lock cylinder being connected with the connecting portion of the locking hook; and the locking hook being moved away from the receiving hole in response to the lock cylinder being unlocked.

7. The lock of claim 6 comprising:

the control unit comprising a locking block, a push key and a lock cylinder housing;

the lock cylinder housing being located at a lower end of the locking block and fixed to the lock cylinder;

the lock cylinder being capable of moving in the space in between the upper casing and the base plate;

the lock cylinder being connected to a rotary block;

the locking block comprising a hole and a rectangle slot;

the hole being formed at a middle of the locking block and matched with the rotary block;

the rectangle slot being communicated with the hole;

the rotary block being inserted into the hole;

the one end of the shaft lever abutting against the locking block;

the connecting portion moving together with the lock cylinder;

the lock cylinder being moved to a right driven by the push key and the locking hook being moved to the right in response to the password being used to unlock a luggage;

the lock cylinder being moved relative to the locking block and the rotary block being moved along the rectangle slot so as to render the locking hook being moved away from the receiving hole to unlock the luggage in response to the lock cylinder being used to unlock the luggage; and a movement of the shaft lever being limited and the rotary block being inserted in the hole in response to the lock being locked.

8. The lock of claim 7 comprising:

the lock cylinder comprising a connecting block under the locking block;

the connecting block comprising a round hole;

the round hole being located at one end of the connecting block;

the round hole being matched with the rotary block; and the other end of the connecting block extruding to form a cavity fitted with an extrusion on the locking hook.

9. The lock of claim 5 comprising:

a lock block;

a retaining rod;

the lock block being located under the resetting block;

the retaining rod being located under the resetting switch block; and the retaining rod fitting into a retaining slot of the lock block.

10. The lock of claim 1 to 5, comprising a top block;

the top block being located inside the receiving hole and under the hook portion;

an elastic element;

the elastic element being used for raising the top block in between the top block and the base plate;

a lower casing; and the lower casing being fixed to the upper casing.

* * * * *